US006155472A

United States Patent [19]

Déziel

[11] Patent Number: 6,155,472

[45] Date of Patent: Dec. 5, 2000

[54] IMPACT BLOW ACTUATED PNEUMATIC FASTENER DRIVING TOOL

[75] Inventor: André Déziel, St-Mathieu-du-Parc, Canada

[73] Assignee: Profilages Cresswell Inc., Granby, Canada

[21] Appl. No.: 09/504,806

[22] Filed: Feb. 16, 2000

[51] Int. Cl.[7] ..... B25C 1/04

[52] U.S. Cl. ..... 227/8; 227/130; 227/147; 227/148

[58] Field of Search ..... 227/8, 10, 147, 227/148, 130

[56] References Cited

U.S. PATENT DOCUMENTS

| | | | |
|---|---|---|---|
| 3,051,135 | 8/1962 | Smith . | |
| 3,542,273 | 11/1970 | Granville . | |
| 4,196,833 | 4/1980 | Haytayan | 227/148 |
| 4,346,831 | 8/1982 | Haytayan | 227/8 |
| 4,907,730 | 3/1990 | Dion . | |
| 5,014,898 | 5/1991 | Heidrich | 227/130 |
| 5,485,946 | 1/1996 | Jankel | 227/8 |
| 5,645,208 | 7/1997 | Haytayan | 227/8 |
| 5,850,961 | 12/1998 | Braun et al. | 227/130 |
| 5,924,621 | 7/1999 | Hung | 227/8 |

*Primary Examiner*—Scott A. Smith
*Attorney, Agent, or Firm*—F. Martineau

[57] ABSTRACT

The nailing tool has a hollow main body including a valve slidable therein. The main body includes a compressed air reservoir, the compressed air keeping the valve closed in a resting position. An anvil is provided at the upper end of the tool, with an empty annular chamber at atmospheric pressure being located under the anvil and over a ring integrally attached to the valve. Thus, if a hammer blow is dealt on the anvil, the latter loosely slides inside the main body, without reaching the ring, with the valve remaining closed and no fastener being expelled from the tool. Upon a trigger being activated on the tool handle, compressed air fills the annular chamber between the anvil and the ring. In this condition, upon a hammer blow being dealt on the anvil, the impact of the blow is transmitted by the compressed air to the underlying ring, consequently opening the valve. The opened valve allows compressed air to flow into an underlying piston drive chamber, where a piston is driven by the sudden compressed air inflow to drive a fastener out of the tool. Air exhaust channels allow the piston and the valve to return in their initial resting positions after a nail has been expelled from the tool.

12 Claims, 9 Drawing Sheets

IMPACT BLOW ACTUATED PNEUMATIC FASTENER DRIVING TOOL

FIELD OF THE INVENTION

The present invention relates to hand held air pressure operated fastener driving tools, and more particularly to a tool which is held in one hand by a handle secured to the tool while applying an impact blow on an anvil of the tool by means of a hammer held by the other hand of the operator.

BACKGROUND OF THE INVENTION

U.S. Pat. No. 3,542,273 dated Nov. 24, 1970, inventor Granville R. Hedrick, discloses a nail driving device especially used for driving nails into a wooden flooring by means of a source of compressed air. The device of this patent is alternately operated by an external impact blow accomplished on the device anvil while the operator's other hand holds a handle of the device; or by squeezing a trigger accessible to the hand holding the handle. The device in accordance with this prior patent thus has a trigger initiated operating system, which is used only as an alternative to the impact blow initiating system. One main disadvantage of the Hedrick nailer is that it does not provide any reliable security means for preventing the nails from being accidentally expelled from the nailer.

U.S. Pat. No. 4,907,730 in 1990, inventor Jean-Paul Dion, shows a pneumatic nailer which includes a feeler disc which must be applied against the ground for the nail driving operation to occur. Indeed, when the feeler disc is applied against the ground, a needle valve located inside the nailer main body closes an inner channel for allowing air to travel between chambers inside the nailer when the hammer is impacted on the anvil, and consequently for allowing the nail to be driven through the floor boards. The Dion patent however does not include a reliable security device for preventing the nails from being accidentally expelled, since the feeler disc will be activated to allow nail expulsion whenever the nailer rests or abuts on a surface with its lower surface.

OBJECTS OF THE INVENTION

It is therefore the main object of the present invention to provide fastener driving tool including a safety device for the impact blow initiating system such that it disables the operation of the impact blow initiating system unless a trigger on the handle is squeezed during the hammer blow.

Another object of the present invention is to provide a tool of the character described in which a trigger is squeezed during the fastener driving operation such that the operator's one hand must firmly hold the tool handle during the hammer blow and thus a possibility of the tool accomplishing an unintended displacement is decreased.

Another object of the present invention is to provide a tool of the character described using the same source of fluid pressure to operate the trigger initiated safety system as the source used to drive the main piston of the tool.

SUMMARY OF THE INVENTION

The present invention relates to an air pressure actuated fastener driving tool comprising;

a body having an upper end and a lower end;

a work-piece engaging base secured to the lower end of said body and defining a passage for receiving a leading fastener from a supply of fasteners and for guiding said leading fastener into a work-piece underlying said base;

a handle fixed relative to said body;

a manually operated trigger operatively mounted to said handle so as to be movable between a rest position and an operating position;

an air reservoir carried by said body with an inlet for connection to a supply of compressed air;

an air operated cylinder and piston unit in said body, comprising a piston movable in a cylinder from an upper rest position to a lower fastener-driving position;

a fastener driver secured to said piston and extending through said lower end of said body and into said base passage in said piston lower position for engaging and driving said leading fastener into the work-piece during downward operative stroke of said piston from its said upper position;

a valve in said body including a valve seat carried by said body between said air reservoir and the cylinder of said unit and a valve member movable between a closed position seated on said valve seat and closing the communication between said air reservoir and said cylinder, and an opened position communicating said air reservoir with said cylinder to cause said operative stroke of said piston;

an impact blow receiving anvil protruding from and movably carried by said upper end of said body for movement between an upper and a lower position;

a lost motion system between said valve member and said anvil to prevent said valve member to move downwardly from said upper closed position when said anvil is moved to its lower position; and a lost motion disabling system connecting said trigger to and disabling said lost motion system when said trigger is in said operating position whereby said fastener driver can only drive said leading fastener if said trigger is moved into said operating position when a hammer blow is imparted on said anvil and moves said anvil to its lower position.

Preferably, said lost motion disabling system is pneumatically operated from the supply of compressed air in said reservoir.

Preferably, said tool further comprises:

a sealed lost motion and lost motion disabling chamber formed in said main;

a poppet member integrally linked to said valve member and having an intermediate portion in fluid-tight relationship with said chamber;

an actuator, integrally attached to said anvil and in fluid-tight relationship with said chamber and spaced from said poppet member intermediate portion, whereby said lost motion and lost motion disabling chamber is formed between said poppet member intermediate portion and said actuator;

an air exhaust port connecting said chamber to the atmosphere when said trigger is in said rest position; and another valve connecting said chamber to said air reservoir and blocking said exhaust port when said trigger is in said operating position; wherein when said trigger is in said rest position, a blow dealt on said anvil will move said actuator down into said chamber although short of said poppet intermediate portion, said chamber thus acting as said lost motion system since the air therein is allowed to exhaust through said exhaust port; and wherein when said trigger is in said operating position, said chamber communicates with said air reservoir for filling said chamber with compressed air, said chamber then acting as a lost motion disabling system since an air cushion is created between said actuator and said poppet member intermediate portion to transmit the impact of a blow dealt on said anvil from said actuator to said poppet member intermediate portion, and consequently to said valve member to move same into said opened position.

Preferably, said another valve is a three-way valve including a plunger connected to said trigger and a valve body secured to said handle with an inlet port connected to said air reservoir, said air exhaust port and a third port connected to said sealed chamber, said another valve member connecting said air reservoir to said sealed air space and said sealed air space to atmospheric air through said exhaust port in the operating and rest position of said trigger respectively.

Preferably, said tool further includes a lateral arm secured to said body and to said handle intermediate the same, said air reservoir formed in said arm.

Preferably, said handle is generally parallel to said base and higher than said anvil.

Preferably, said tool includes a lateral arm secured to said body and to said handle intermediate the same, said air reservoir formed in said arm, the handle generally parallel to said base and higher than said anvil, and wherein said three-way valve is mounted close to said trigger and further including an air passage extending through said arm separate from said air reservoir and communicating said sealed air space to said third port through an air conduit made in said body.

Preferably, said tool further including a pneumatic return system to return said piston and said valve member to their upper and closed position respectively, upon completion of said operative stroke of said piston.

Preferably, said poppet member is tubular and carries said valve member at a lower end thereof, said valve member also being tubular and having a generally downwardly diverging conical shape and being provided with an annular groove therein, said groove having a truncated circular cross-section with converging outer edges, said groove being fitted with a resilient O-ring for sealing engagement thereof against said seat in said closed position of said valve member.

Preferably, said tool body includes a lower chamber in which said piston is movable between said upper and lower positions, said piston upwardly extending into said tubular poppet member and protruding under said valve member, said piston carrying a slider disc in fluid-tight relationship with said lower chamber and guiding said piston in its movements between said upper and lower position, said piston including a tubular stem having an inner channel linking said lower chamber above said slider disc to the atmospheric air; and wherein an annular channel closed at its lower end is defined between said piston and said tubular poppet member surrounding said piston, said piston being provided at its upper end with a short sleeve fixedly attached to said piston and sealingly slidably engaging said poppet member, said poppet member annular chamber having channels therein linking same to said air reservoir, whereby compressed air is continuously present in said annular poppet member chamber for continuously biasing said piston towards said upper position by applying an upwardly oriented pressure on said sleeve member.

Preferably, said tubular piston opens into an upper chamber formed in said body and including an exhaust channel to atmospheric pressure, and said body further including a dampening chamber located above said upper chamber in which said piston moving upwardly will be decelerated before reaching its upper position.

Preferably, said trigger protrudes from said handle in said rest position of said trigger, and wherein said trigger must be squeezed against said handle to reach said operating position.

DETAILED DESCRIPTION OF THE PREFERRED EMBODIMENT

Figure 1:
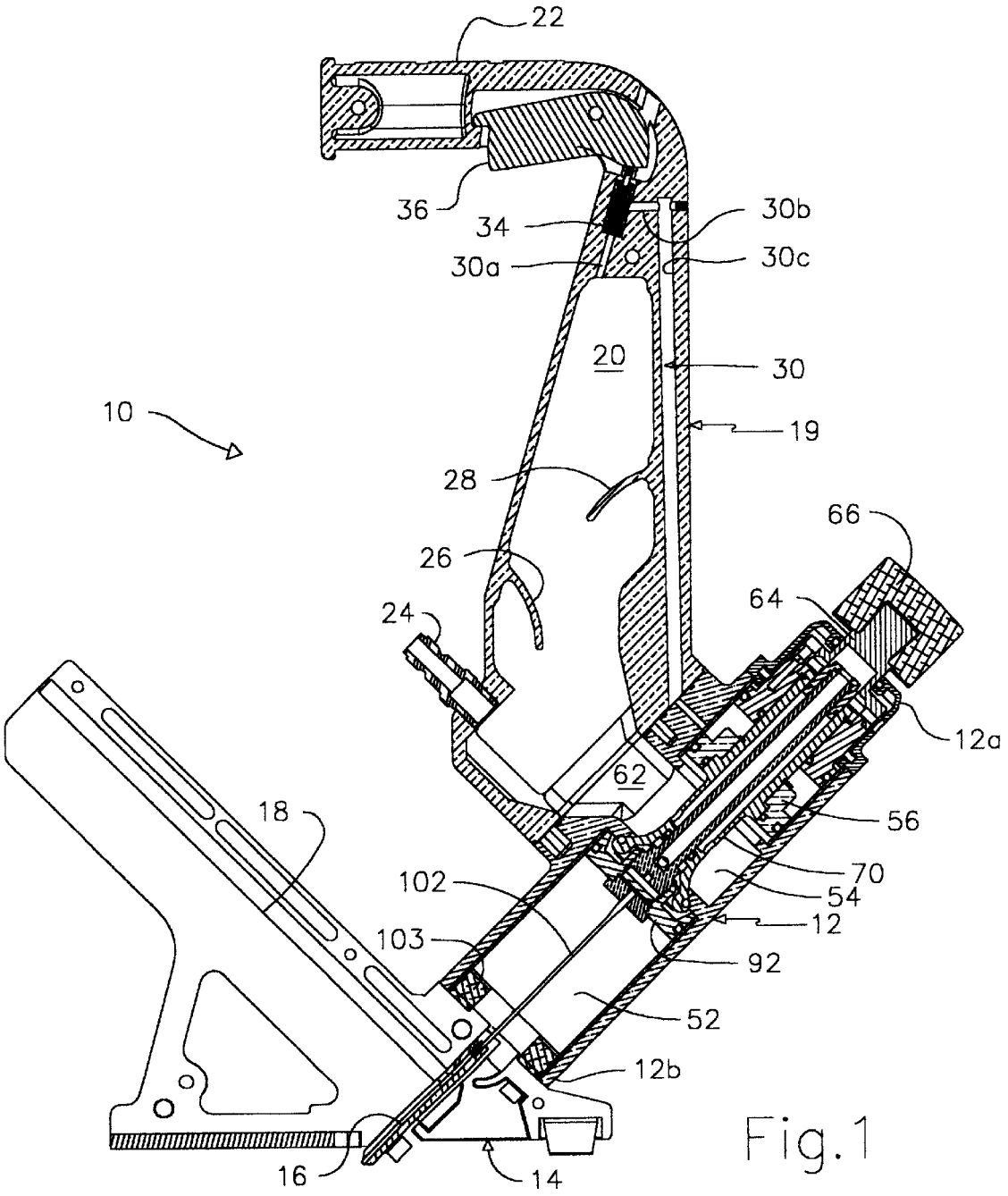
FIG. 1 is a vertical, sectional elevation of a pneumatic fastener driving tool according to the invention, in a rest position.

FIG. 1 shows a pneumatic fastener driving tool 10 according to the present invention. Tool 10 comprises a hollow main body 12 having an upper end 12*a* and a lower end 12*b* and a work-piece engaging base 14 of known construction secured to the lower end 12*b* of main body 12. Base 14 includes a passage 16 for receiving a leading fastener (not shown) from a supply of spring-loaded fasteners (not shown) fed from a fastener magazine 18 of conventional construction. Passage 16 will also guide the leading fastener as known in the art into a work-piece underlying the base, e.g. through a floorboard, when the leading fastener is expelled as described hereinafter.

Tool 10 further includes a handle portion 19 integrally attached to and forming part of body 12, handle portion 19 forming a lateral arm integrally protruding from main body 12 and including an inner air reservoir 20 which is in fluid connection with an intermediate portion of hollow main body 12, as detailed hereinafter. Handle portion 19 integrally carries a handle 22 at its upper end. Reservoir portion 19 has an inlet 24 for fluid connection of reservoir 20 to a supply of compressed air. Thus, during use of tool 10, reservoir 20 is filled with compressed air. Reservoir 20 comprises inner reinforcing ribs 26, 28, which are aerodynamically curved to favour air flow towards main body 12 in reservoir 20.

Figure 2:
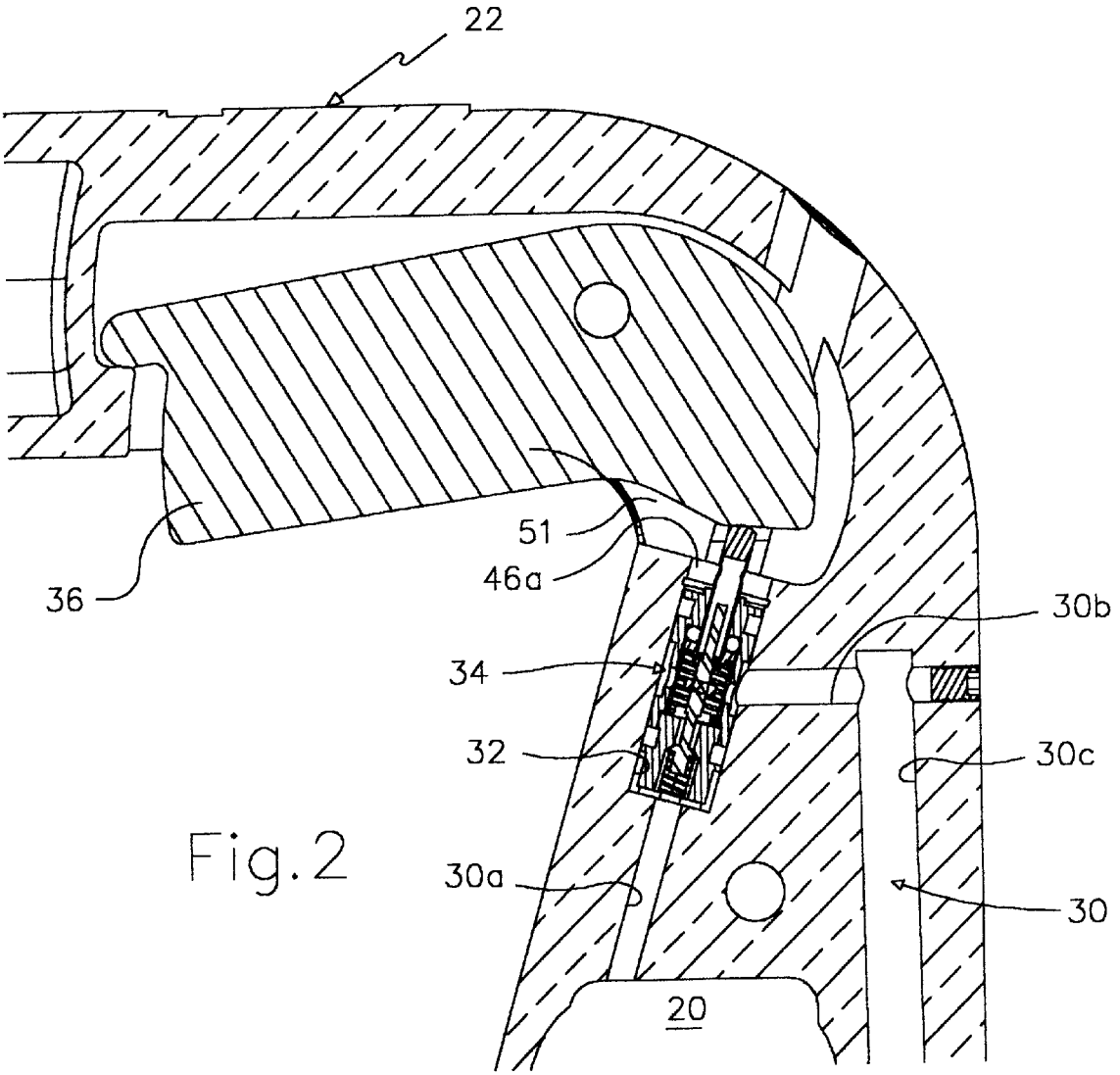
FIG. 2 is an enlarged sectional view of the upper handle portion of the tool of FIG. 1, more particularly showing the three-way valve and the trigger in a rest position.

As shown in FIGS. 1 and 2, handle portion 19 further comprises a U-shaped channel generally referred to with numeral 30, comprising three sections 30*a*, 30*b*, 30*c*. First channel section 30*a* is in fluid communication with reservoir 20, and leads to a three-way valve chamber 32 which includes a three-way valve 34 of known construction, selectively activated by a trigger 36 pivotally attached under handle 22.

Figure 4:
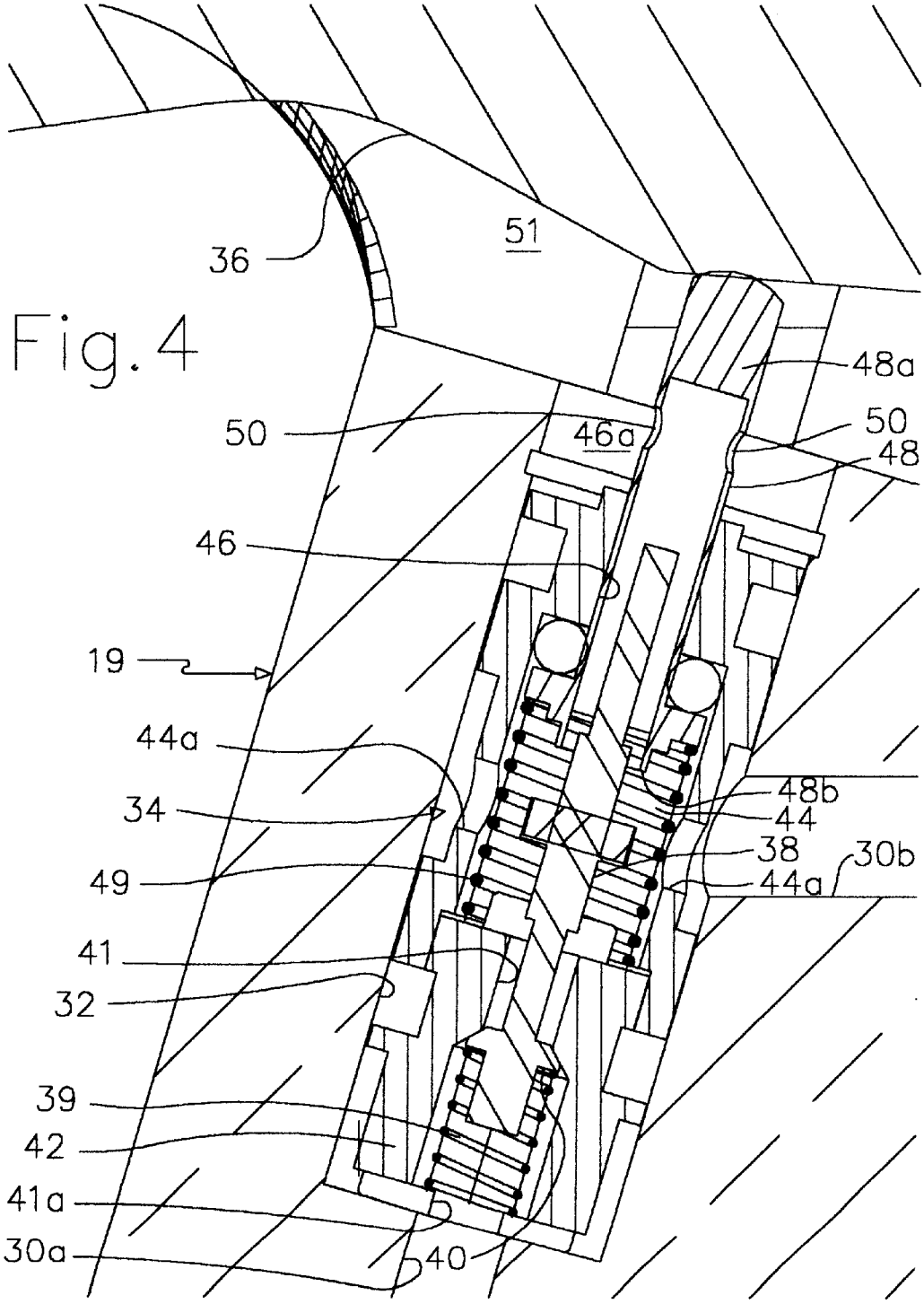
FIG. 4 is an enlarged sectional view of the three-way valve of FIG. 2.
Figure 5:
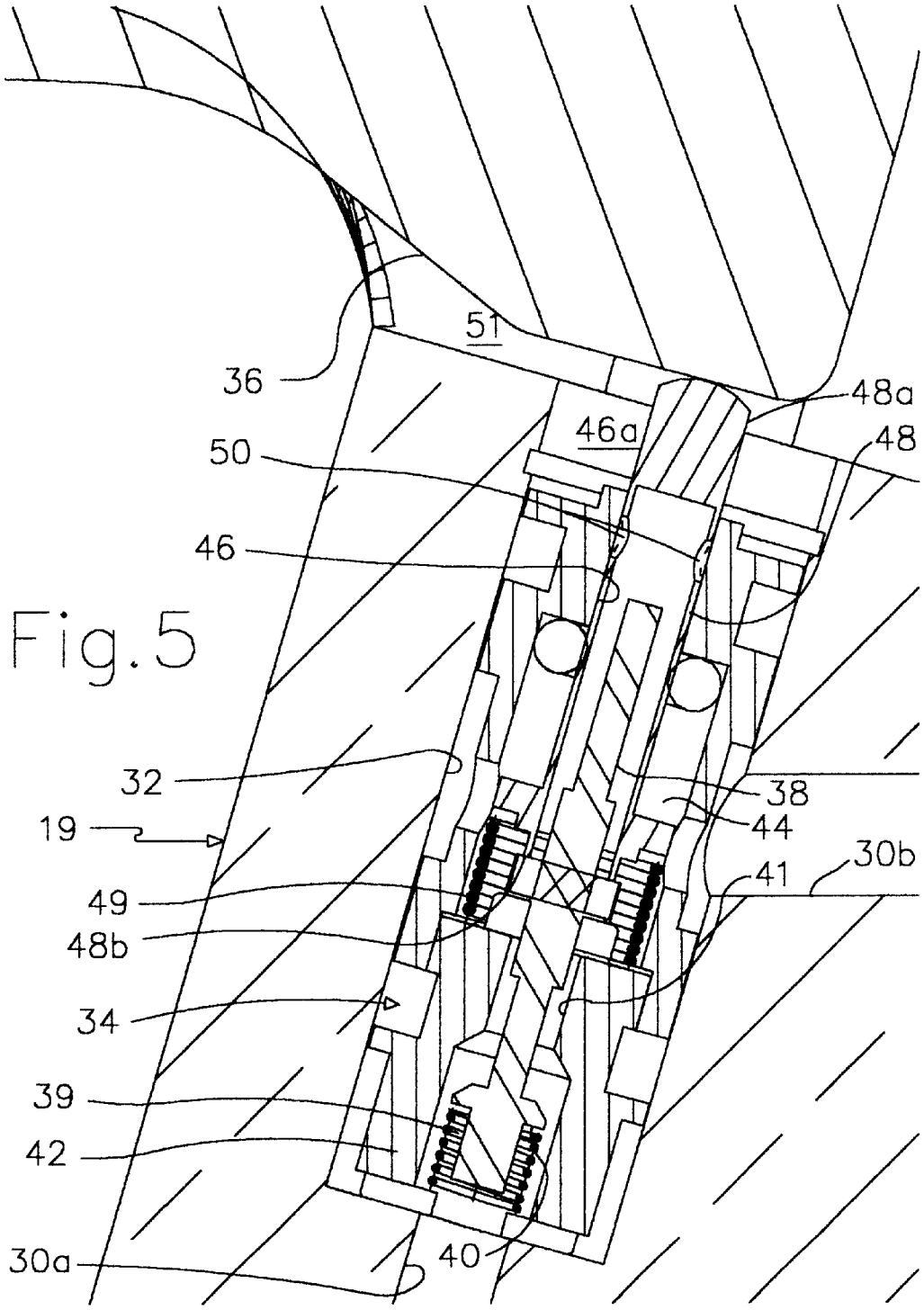
FIG. 5 is an enlarged sectional view of the three-way valve of FIG. 3.

Three-way valve 34 is of known construction, and works generally as follows. As shown in FIGS. 4 and 5, three-way valve 34 comprises a main body 42 having a lower passage 41, an intermediate chamber 44 and an upper passage 46. An inlet port 41*a* connects lower passage 41, through first channel section 30*a*, to air reservoir 20; an exhaust port 46*a* connects upper passage 46 to the ambient air outside of tool 10; and a third lateral port in the form of several peripherally spaced-apart radial apertures 44*a* in the valve body 42, connects intermediate chamber 44 to second and third channel sections 30*b*, 30*c*. A plunger 38 is slidable inside lower passage 41 between a lower and an upper position, with a spring 39 continuously biasing plunger 38 towards its upper limit position shown in FIG. 4. Plunger 38 comprises a lower annular shoulder 40 which serves as a seat for spring 39 and which sealingly blocks lower passage 41 in the plunger upper limit position. Air passage through passage 41 is allowed when plunger 38 is in its lower limit position.

A sleeve 48 is slidable in the upper passage 46 between an upper limit position (FIG. 4) in which ambient air at the atmospheric pressure may pass through radial holes 50 in sleeve 48 to the intermediate chamber 44, and a lower limit position (FIG. 5) in which radial holes 50 register with and are sealingly blocked by the wall of the upper passage 46. A spring 49 continuously biases sleeve 48 towards its upper limit position. Valve 34 may be connected to the ambient air at atmospheric pressure since exhaust port 46*a* is adjacent to and in fluid communication with a cavity 51 formed around trigger 36 in handle 22. Trigger 36 abuts against the upper tip portion 48*a* of sleeve 48 at all times.

Thus, in a resting position of trigger 36 shown in FIGS. 2 and 4, ambient air at atmospheric pressure may enter through three-way valve 34 and engage the second and third sections 30*b*, 30*c* of channel 30, while annular shoulder 40 blocks air output from air reservoir 20 through three-way valve 34. However, when trigger 36 is manually forcibly pivoted in its operating position in abutment over the sleeve tip portion 48*a*, it downwardly forces sleeve 48 against the bias of springs 39, 49 into its lower limit position, sleeve 48 then engaging with its lower end 48*b* plunger 38 which is also consequently lowered into its lower limit position, thus allowing fluid connection through three-way valve 34 between first channel section 30*a* and second channel section 30*b* while blocking ambient air from flowing through three-way valve 34.

Figure 6:
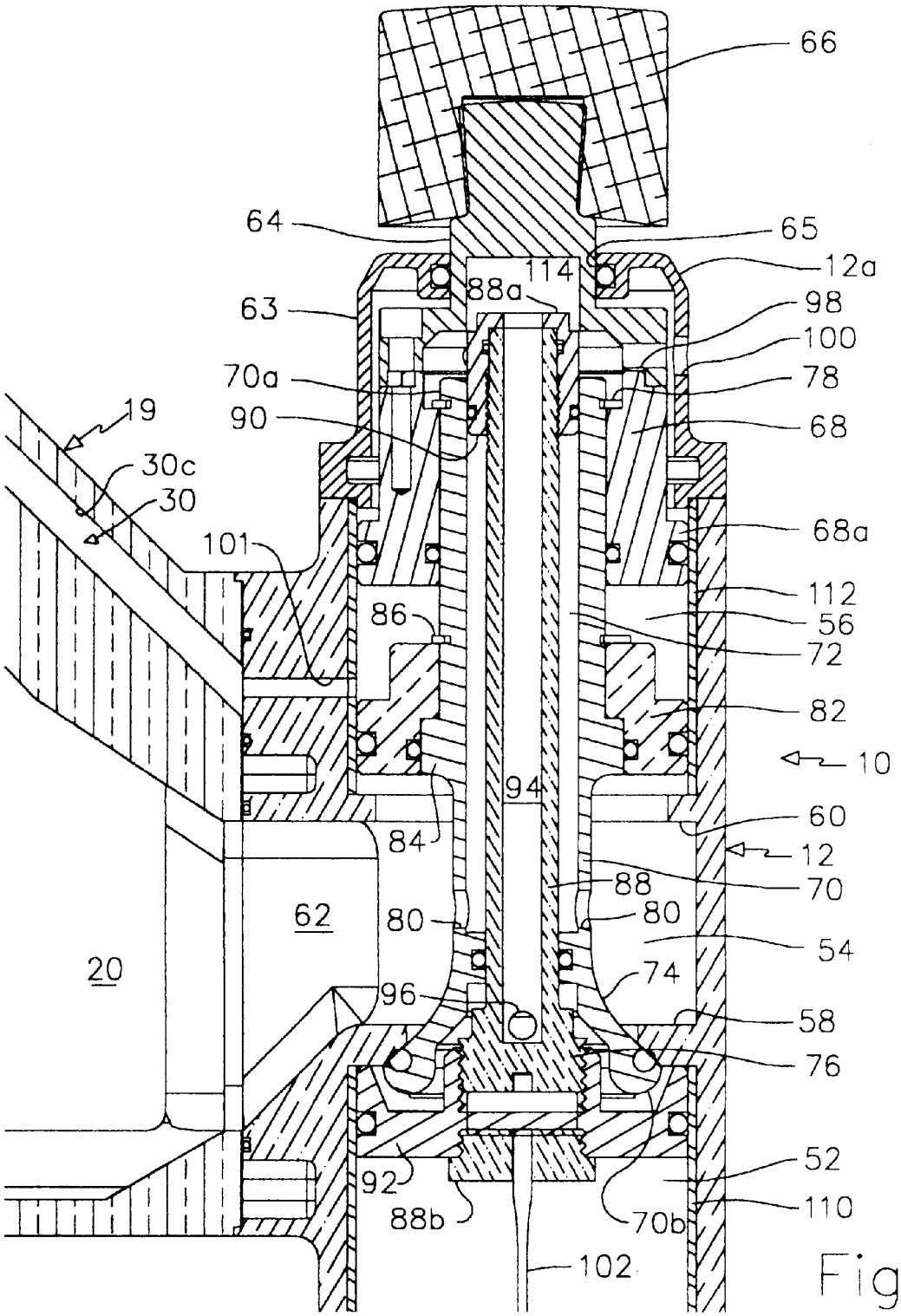
FIG. 6 is an inclined sectional view, at a larger scale, of the nail-driving mechanism of the tool of FIG. 1, showing more particularly the upper and intermediate portions of the tool, with the valve member being shown in a closed position and with the piston being shown in an upper limit position.
Figure 7:
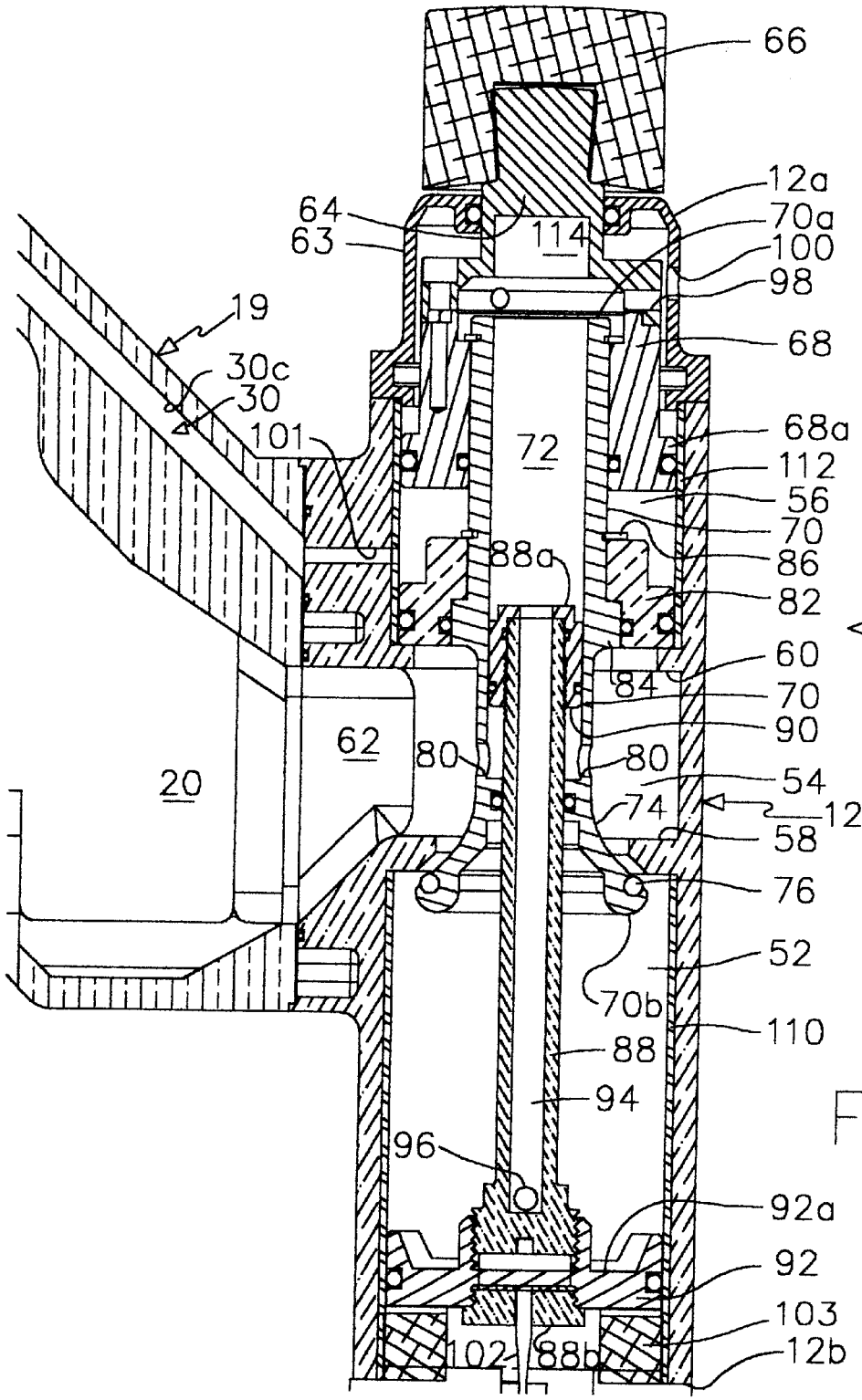
FIG. 7 is a view similar to FIG. 6, but showing a longer portion of the tool main body, exclusive of the base portion, with the valve member being shown in an opened position and with the piston being shown in a lower nail-driving position.
Figure 8:
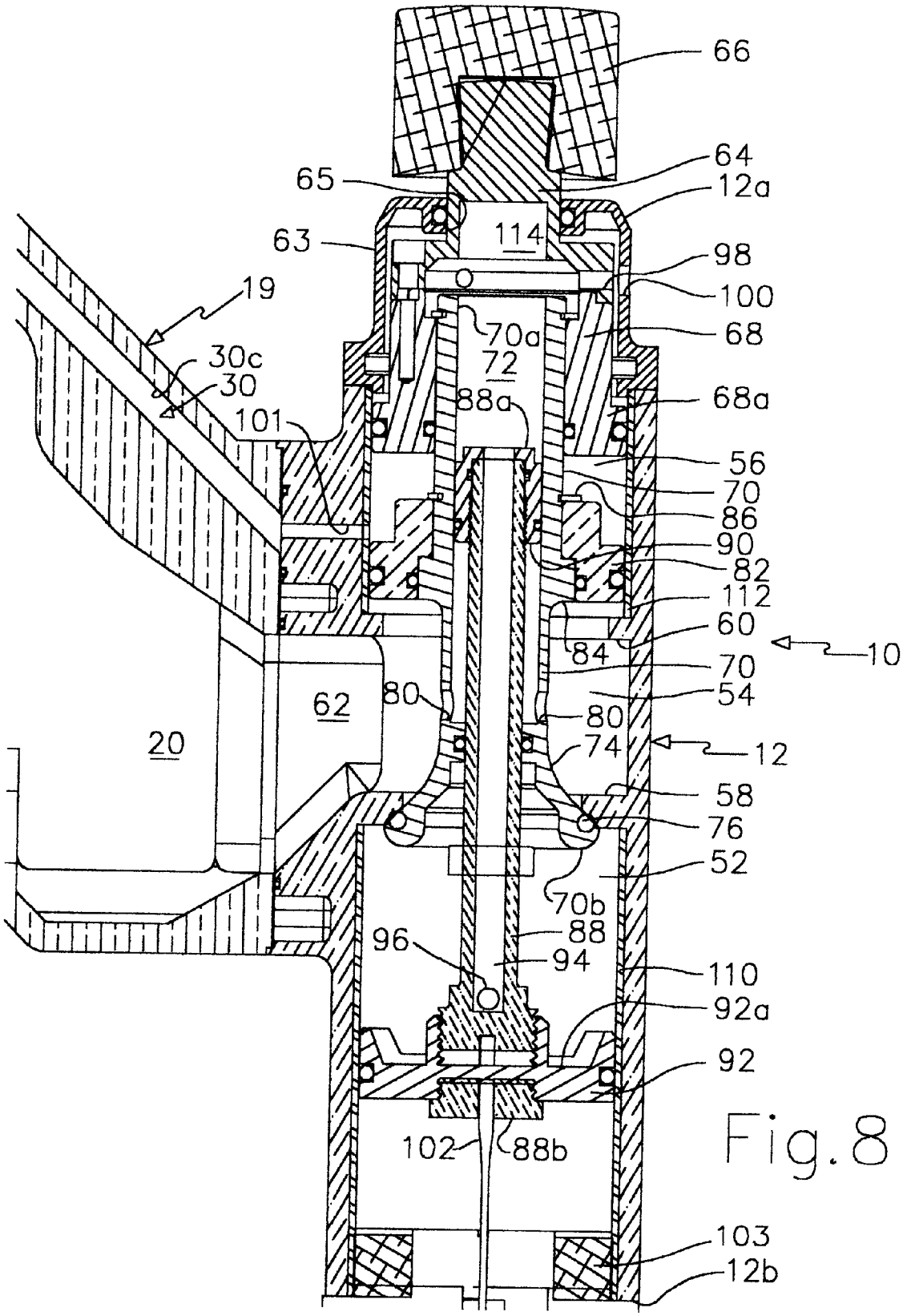
FIG. 8 is a view similar to FIG. 7, but with the valve member in a closed position and with the piston being shown in an intermediate position.

As shown in FIGS. 6–8, the fastener driving tool main body 12 comprises three distinct inner chambers, namely a lower chamber 52, an intermediate chamber 54 and an upper chamber 56. A first annular seat 58 integrally formed in the main body inner wall separates the lower and intermediate chambers 52 and 54, while a second annular seat 60 integrally formed in the main body inner wall separates the intermediate and upper chambers 54 and 56. A large opening 62 allows continuous fluid exchange between air reservoir 20 and intermediate chamber 54.

Main body 12 is fitted at its upper end 12*a* with a fixedly attached cover 63 from which protrudes a slidable anvil member 64 through a top chimney opening 65, anvil member 64 being covered with a soft cap 66, as known in the art. Anvil 64 is diametrally slightly spaced from the inner wall of cover 63, so as to allow air circulation therebetween. Anvil member 64 is fixedly attached at its lower end inside body 12 to an annular actuator 68, the lower diametrally larger end 68*a* of which being axially slidable in a fluid-tight fashion inside upper chamber 56, under cover 63, and guiding both actuator 68 and anvil 64 in their sliding motion. Annular actuator 68 peripherally slidably and sealingly engages the outer surface of a hollow cylindrical poppet member 70 having an upper end 70*a* and a lower end 70*b* and which defines an inner channel 72. The poppet member lower end 70*b* includes a valve member 74 in the form of a diverging conical lower portion of poppet member 70. Valve member 74 comprises an annular sealing O-ring 76 fixedly installed thereon, as described hereinafter. As shown in FIGS. 6–8, valve member 74 is destined to releasably and peripherally engage in fluid-tight fashion the chamfered lower annular seat 58.

Poppet member 70 has an annular groove spacedly under and adjacent its upper end 70*a*, securely engaged by a snap-ring 78, the latter forming a peripheral abutment shoulder for actuator 68, for preventing actuator 68 from upwardly moving beyond snap-ring 78 relative to poppet member 70. Poppet member 70 also includes several peripherally spaced radial through-bores 80 (with two bores 80 being shown in the drawings) spacedly over and near valve member 74.

An annular stepped ring member 82 is fixedly and sealingly attached on the intermediate portion of poppet member 70, and more particularly between an annular bulge 84 on poppet member 70 and a snap-ring 86 securely fitted in an annular groove spacedly above bulge 84. Stepped ring member 82 slidably and sealingly engages the inner wall of upper chamber 56, and is destined to releasably downwardly abut against the upper surface of upper seat 60, as described hereinafter.

A hollow piston or plunger 88 having an upper end 88*a* and a lower end 88*b* is axially slidable inside the poppet member channel 72, with piston 88 being guided by means of a short upper sleeve 90 which slidably and sealingly engages the inner wall of poppet member 70 at the piston upper end 88*a*, and by a slider disc 92 which is threadingly and sealingly attached at the piston lower end 88*b* and which slidingly and sealingly engages the main body 12 inner wall in lower chamber 52. Slider disc 92 presents a cross-sectionally upwardly convergent annular trough 92*a*.

A central channel 94 is defined longitudinally inside piston 88, being opened at piston upper end 88*a*. Since piston 88 comprises several peripherally spaced-apart through bores 96 (with a single bore 96 being shown in the drawings) near its lower end 88*b* although spacedly over disc 92, there is continuous fluid communication through piston channel 94 between:

a) the portion of upper chamber 56 located above actuator 68 and poppet member channel 72 above short sleeve 90 when piston 88 is at least partly lowered; and b) the portion of lower chamber 52 located above slider disc 92.

Several peripherally spaced-apart exhaust holes 98 are made between the lower edge of anvil 64 and the upper portion of actuator 68, where both loosely fit inside cover 63. Several other peripherally spaced-apart exhaust holes 100, generally registering with holes 98, are made in cover 63. A single hole 98 and a single hole 100 are shown in the drawings. Holes 100 lead outside of cover 63, to the ambient air.

A channel 101 in main body 12 links the U-channel third section 30*c* with the main body upper chamber 56, between actuator 68 and stepped disc 82.

The lower end 88*b* of piston 88 carries a fastener driver in the form of a driver blade 102 which is fixedly attached to the piston lower end 88*b* under disc 92 and which downwardly extends through base 14 in channel 16. An annular pad 103 is located at the bottom end portion of lower chamber 52, to receive and absorb the impact of the downwardly propelled disc 92.

Figure 9:
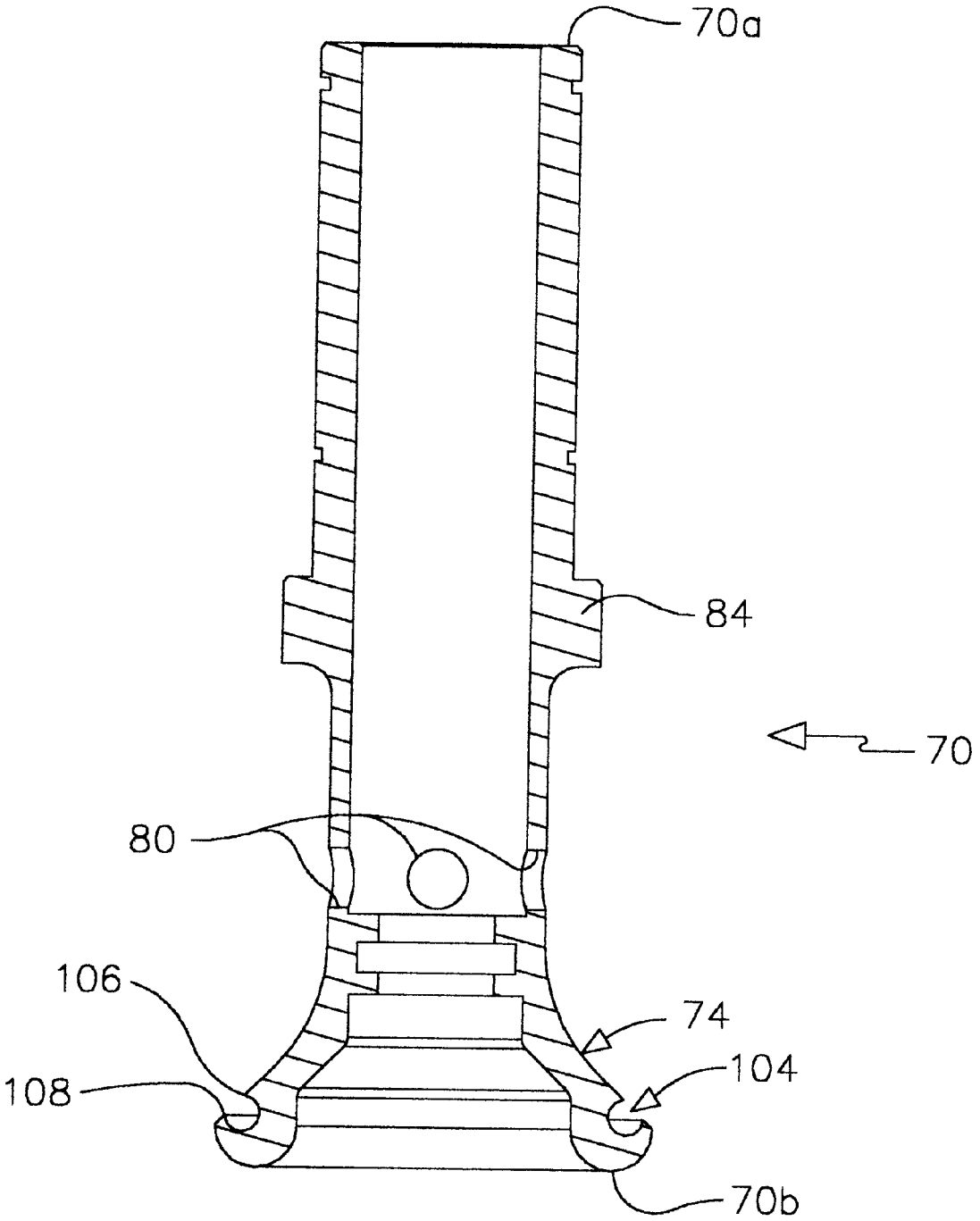
FIG. 9 is an enlarged front elevation of the poppet member according to the invention.

FIG. 9 shows poppet member 70. It can be seen that the valve portion 74 of poppet member 70 includes an annular groove 104 which has a truncated circular cross-section having converging outer edges 106, 108. Thus, O-ring seal 76 (not shown in FIG. 9) can be resiliently forced into groove 104 to be installed therein, without any glue or other adhesive being required to securely fix O-ring 76 into groove 104. This is an important improvement over the prior art devices, such as the Hedrick patent discussed in the Background of the Disclosure section of the present specification, in which the groove was cross-sectionally L-shaped and consequently included divergent outer edges, and in which a glue or other adhesive, or a metal bonding method, was used to secure the O-ring seal to the valve member. The consequence of this in prior art devices, was that over time the O-ring was often accidentally released due to the glue or metal bonding becoming less efficient, which rendered the nailer less efficient or dysfunctional. Also, the metal bonding or glue used to fix the O-ring to the valve member, often prevents another O-ring from being installed at the position of the old, deficient O-ring. Thus, the whole valve member must be replaced even if only the O-ring becomes worm, the latter being very likely to occur at least once during the lifetime of a pneumatic fastener driving tool such as tool 10. It is understood that the price difference between a resilient O-ring and the whole valve member is quite important, and thus having to replace the whole valve member because of a worn O-ring is highly undesirable. The O-ring of the present invention, resiliently forced into the annular channel having convergent outer edges, allows an easy installation and replacement of the O-ring 76 when it becomes worn, thus effectively reducing the manufacturing cost and the maintenance labour costs of the tool.

It is noted that lower and upper chambers 52, 56 are fitted with rigid cylindrical sheets 110, 112 having smooth inner surfaces, to provide a smooth sliding engagement thereon of slider disc 92 in lower chamber 52 and of stepped ring member 82 and actuator 68 in upper chamber 56. As known in the art, sheets 110, 112 are provided since the inner walls of main body 12 have been machined with a rougher inner surface.

As also known in the art, anvil 64 is formed with a diametrally smaller upper chamber 114 at its upper end, which acts as a shock absorber to dampen the upward movement of piston 88 when it is biased upwardly after a fastener has been driven by the action of the air pressure on the short sleeve 90. Indeed, once the upper end of sleeve 90 and piston 88 extend into chamber 114, the air therein will act as a dampening cushion to help prevent eventual fatigue failure of tool 10 under the repeated impacts of the piston slider disc 92 against lower seat 58.

In use, the fastener driving tool 10 is in a resting position as shown in FIGS. 1, 2, 4 and 6. Compressed air is continuously fed into air reservoir 20 through inlet 24. In this position, U-channel second and third sections 30*b*, 30*c* communicate with the ambient air through three-way valve 34, and thus atmospheric pressure exists in the annular area of main body upper chamber 56 between actuator 68 and stepped ring member 82. Also, through exhaust holes 100 and 98, and through upper chamber 56 (above actuator 68) and piston channel 94, atmospheric pressure exists in the small area of lower chamber 52 between the poppet valve member 74 and the piston slider disc 92. Through the opened base 14, ambient air is allowed in lower chamber 52 under slider disc 92 and piston 88, and lower chamber 52 is thus at atmospheric pressure. However, intermediate chamber 54, being in continuous communication with air reservoir 20, is filled with compressed air. Since the lower face of the integrally-linked poppet radial bulge 84 and stepped disc 82 has a greater surface than the horizontal surface value of the upper conical face of valve member 74, the overall pressure differential on the poppet member 70 is upwardly oriented, and consequently valve member 74 is upwardly biased in an upper limit position, sealingly engaging the chamfered under face of lower seat 58. Compressed air is also allowed through bores 80 into poppet channel 72 under sleeve 90, to upwardly bias sleeve 90 and consequently to upwardly bias piston 88 in an upper limit position.

In this resting position of tool 10, if a blow is dealt onto anvil 64, actuator 68 will be consequently downwardly biased in upper chamber 56, forcing part of the air therein out through U-channel second and third sections 30*b*, 30*c* and out of tool 10 through three-way valve 34. The air initially at atmospheric pressure which remains in the annular area between actuator 68 and stepped ring member 82 may be slightly compressed, but the calibrated sizes of the inner components of tool 10 are such that the slight additional pressure on the upper face of stepped ring member 82 will not be sufficient to counteract the pressure of compressed air thereunder. Thus, stepped ring member 82 and consequently poppet valve member 74 remain motionless. Due to cap 66 being diametrally larger than the cover opening 65, the downward stroke of anvil 64 is limited to a maximum value which is less than the distance required by actuator 68 to reach stepped ring member 82. Consequently, if trigger 36 is not squeezed, dealing a blow on anvil 64 will not result in a fastener being expelled from tool 10, since no action results from actuator 68 being downwardly biased in this condition of tool 10.

To drive the leading fastener with blade 102, two things have to be accomplished: firstly, trigger 36 must be squeezed, and secondly while trigger 36 remains squeezed, a blow must be dealt on anvil 64.

Figure 3:
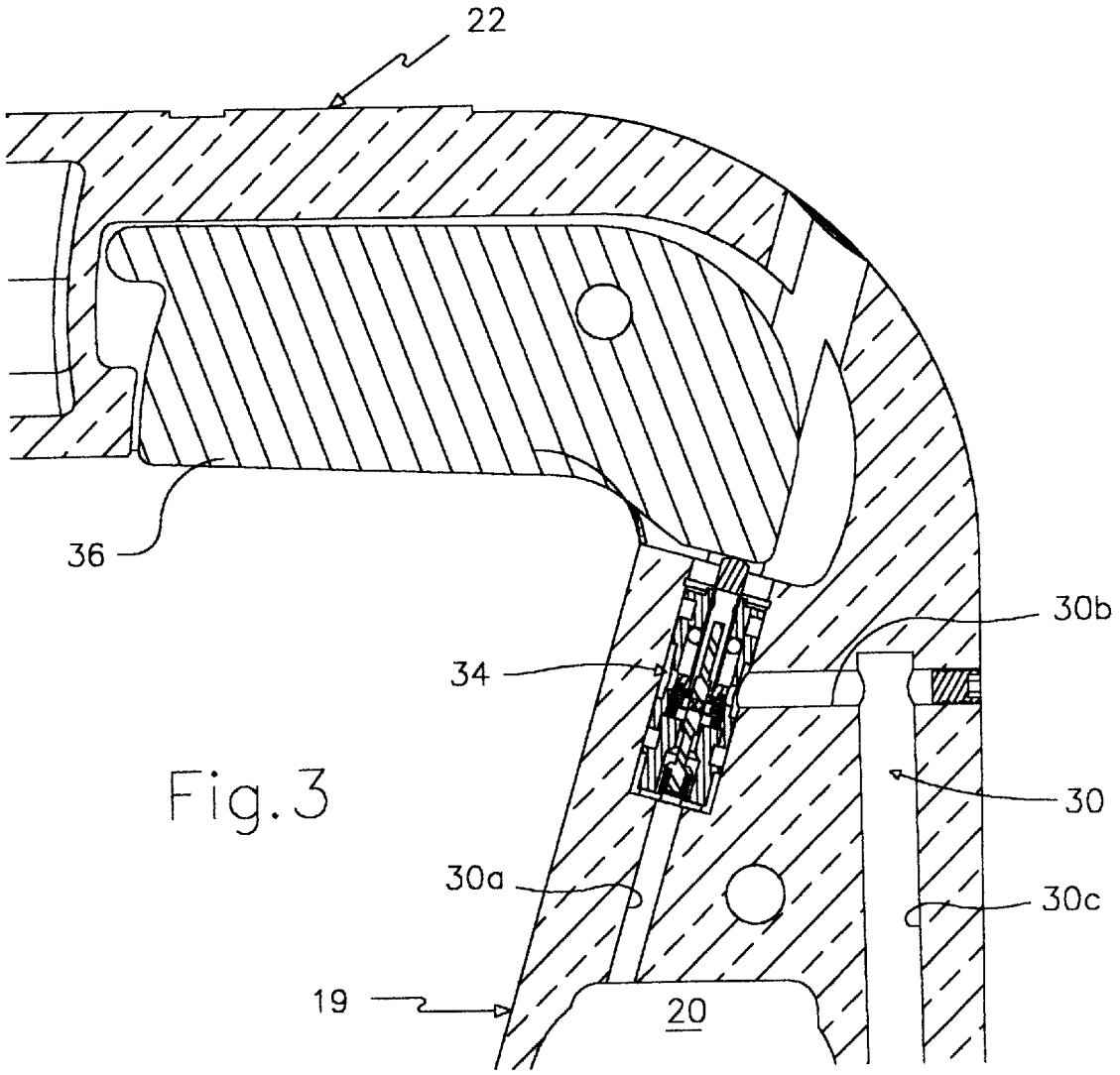
FIG. 3 is similar to FIG. 2, but with the trigger being shown in a squeezed operating position.

When trigger 36 is squeezed, as shown in FIGS. 3 and 5 and as discussed hereinabove, ambient air is no more allowed into U-channel 30. Instead, three-way valve 34 allows compressed air from air reservoir 20 to fill U-channel 30 and to enter the annular area in tool main body upper chamber 56 between actuator 68 and stepped ring member 82, to form a compressed air cushion therein. Actuator 68 is upwardly driven, by the underlying compressed air cushion, to an upper limit position shown in FIG. 6, in which actuator 68 upwardly abuts against snap-ring 78. In this condition of tool 10, the equilibrium of poppet member 70 is not compromised, since the upwardly oriented air pressure on the lower surface of actuator 68 is equal to the downwardly oriented air pressure on the upper surface of stepped ring 82, since their horizontal surfaces are of equal value. Thus, poppet member 70 remains in its upper limit position, with valve member 74 still sealingly closing the passage between lower and intermediate chambers 52, 54.

When a blow is dealt on the anvil 64, e.g. with a hammer, the air cushion between actuator 68 and stepped ring member 82 acts to transfer the impact of this blow to stepped ring member 82 in the form of an added downward pressure thereon, thus effectively downwardly biasing poppet member 70, as shown in FIG. 7. Of course, the force of the blow dealt on anvil 64 must be sufficient to counteract the pressure differential resulting from the surface differential between the stepped ring 82 and the valve member 74. Once poppet member is downwardly biased, the compressed air is allowed to flow around valve member 74, into lower chamber 52 above slider disc 92. Since atmospheric pressure exists under disc 92, the latter is suddenly downwardly driven by the incoming compressed air, to downwardly drive blade 102 and consequently forcefully expel a fastener from tool 10. Since the horizontal component of the downwardly biased upper face of disc 92 is much greater than the counter-acting horizontal annular under face of the upwardly biased short sleeve 90 located at the upper end of piston 88, the resistance exerted by short sleeve 90 to the downward movement of piston 88 is not significant. Once piston 88 hits annular pad 103, it reaches its lowermost position.

Independently of whether trigger 36 is released or not, poppet valve 74 automatically retrieves its resting position after the hammer blow is dealt, due to the greater pressure applied by the compressed air on stepped ring 82 than on poppet valve 74 as described hereinabove. Indeed, the hammer blow on anvil 64 only temporarily shifts the pressure balance in the tool main body 12, which will rapidly return to its initial condition after the hammer blow has been dealt. Thus, as shown in FIG. 8, poppet valve member 74 sealingly engages lower annular seat 58 once again under the bias of the upwardly moving stepped ring 82. The compressed air in the lower chamber 52 above slider disc 92 then flows through holes 96 into piston channel 94, through poppet channel 72 (above sleeve 90) and out of tool 10 through exhaust holes 98 and 100.

Once the pressure in lower chamber 52 above disc 92 nears the atmospheric pressure, the upward pressure applied by the compressed air against sleeve 90 upwardlly biases piston 88 in poppet channel 72 as shown in FIG. 8, back to its initial upper limit position as shown in FIG. 6. Thus, tool 10 retrieves its initial resting condition. As already explained and as known in the art, the upward movement of piston 88 is dampened when it nears its upper limit position, by the presence of an air cushion at atmospheric pressure in dampening chamber 114.

It can be seen that according to the present invention, the combination of the annular space in the main body upper chamber 56 located between actuator 68 and stepped ring 82, together with three-way valve 34, plays two roles:

a) it is a lost motion system when said annular space is filled with air at atmospheric pressure which is allowed to exhaust through three-way valve 34 outside of tool 10, since any blow dealt on anvil 64 does not have any repercussion over actuator 68; and b) it is a lost motion disabling system when said annular space is filled with compressed air, since the pressure of any blow dealt on anvil 64 is then transmitted to actuator 68.

The nailer according to the present invention is a safe tool, since it requires two actions to take place concurrently to expel a nail: squeezing the trigger 36 and dealing a blow on anvil 64. It is important to note that having to deal a blow on top of anvil 64 is not a drawback relative to the existing devices which only require a trigger to be activated for the nail to be expelled. Indeed, the blow dealt on the upper portion of the tool 10, and more particularly on anvil 64, is axially aligned with the direction in which the fastener is to be expelled. As know by the person skilled in the art of the present invention, this directed axial blow is desirable, since it helps to maintain the work-piece engaging base 14 firmly against the work-piece being nailed, e.g. the flooring. The tool has a natural tendency to be lifted slightly over the flooring when a fastener is expelled due to the outcoming fastener hitting the hard floor, which may result in the fastener not being properly driven through the floor. The blow dealt on the anvil helps to prevent the tool from this slight upward reaction movement, since it drives the tool towards the floor.

It is understood that although compressed air is the favoured and effectively the most used fluid for fastener driving tools, any other suitable compressible fluid could be used without departing from the scope of the present invention.

Any further modification, which does not deviate from the present invention, is considered to be included therein.

What is claimed is:

1. An air pressure actuated fastener driving tool comprising;

a body having an upper end and a lower end;

a work-piece engaging base secured to the lower end of said body and defining a passage for receiving a leading fastener from a supply of fasteners and for guiding said leading fastener into a work-piece underlying said base;

a handle fixed relative to said body;

a manually operated trigger operatively mounted to said handle so as to be movable between a rest position and an operating position;

an air reservoir carried by said body with an inlet for connection to a supply of compressed air;

an air operated cylinder and piston unit in said body, comprising a piston movable in a cylinder from an upper rest position to a lower fastener-driving position;

a fastener driver secured to said piston and extending through said lower end of said body and into said base passage in said piston lower position for engaging and driving said leading fastener into the work-piece during downward operative stroke of said piston from its said upper position;

a valve in said body including a valve seat carried by said body between said air reservoir and the cylinder of said unit and a valve member movable between a closed position seated on said valve seat and closing the communication between said air reservoir and said cylinder, and an opened position communicating said air reservoir with said cylinder to cause said operative stroke of said piston;

an impact blow receiving anvil protruding from and movably carried by said upper end of said body for movement between an upper and a lower position;

a lost motion system between said valve member and said anvil to prevent said valve member to move downwardly from said upper closed position when said anvil is moved to its lower position; and a lost motion disabling system connecting said trigger to and disabling said lost motion system when said trigger is in said operating position whereby said fastener driver can only drive said leading fastener if said trigger is moved into said operating position when a hammer blow is imparted on said anvil and moves said anvil to its lower position.

2. A tool as defined in claim 1, wherein said lost motion disabling system is pneumatically operated from the supply of compressed air in said reservoir.

3. A tool as defined in claim 2, further comprising:

a sealed lost motion and lost motion disabling chamber formed in said main body;

a poppet member integrally linked to said valve member and having an intermediate portion in fluid-tight relationship with said chamber;

an actuator, integrally attached to said anvil and in fluid-tight relationship with said chamber and spaced from said poppet member intermediate portion, whereby said lost motion and lost motion disabling chamber is formed between said poppet member intermediate portion and said actuator;

an air exhaust port connecting said chamber to the atmosphere when said trigger is in said rest position; and another valve connecting said chamber to said air reservoir and blocking said exhaust port when said trigger is in said operating position;

wherein when said trigger is in said rest position, a blow dealt on said anvil will move said actuator down into said chamber although short of said poppet intermediate portion, said chamber thus acting as said lost motion system since the air therein is allowed to exhaust through said exhaust port; and wherein when said trigger is in said operating position, said chamber communicates with said air reservoir for filling said chamber with compressed air, said chamber then acting as a lost motion disabling system since an air cushion is created between said actuator and said poppet member intermediate portion to transmit the impact of a blow dealt on said anvil from said actuator to said poppet member intermediate portion, and consequently to said valve member to move same into said opened position.

4. A tool as defined in claim 3, wherein said another valve is a three-way valve including a plunger connected to said trigger and a valve body secured to said handle with an inlet port connected to said air reservoir, said air exhaust port and a third port connected to said sealed chamber, said another valve member connecting said air reservoir to said sealed air space and said sealed air space to atmospheric air through said exhaust port in the operating and rest position of said trigger respectively.

5. A tool as defined in claim 4, including a lateral arm secured to said body and to said handle intermediate the same, said air reservoir formed in said arm, the handle generally parallel to said base and higher than said anvil, and wherein said three-way valve is mounted close to said trigger and further including an air passage extending through said arm separate from said air reservoir and communicating said sealed air space to said third port through an air conduit made in said body.

6. A tool as defined in claim 4, further including a pneumatic return system to return said piston and said valve member to their upper and closed position respectively, upon completion of said operative stroke of said piston.

7. A tool as defined in claim 6, wherein said poppet member is tubular and carries said valve member at a lower end thereof, said valve member also being tubular and having a generally downwardly diverging conical shape and being provided with an annular groove therein, said groove having a truncated circular cross-section with converging outer edges, said groove being fitted with a resilient O-ring for sealing engagement thereof against said seat in said closed position of said valve member.

8. A tool as defined in claim 7, wherein said tool body includes a lower chamber in which said piston is movable between said upper and lower positions, said piston upwardly extending into said tubular poppet member and protruding under said valve member, said piston carrying a slider disc in fluid-tight relationship with said lower chamber and guiding said piston in its movements between said upper and lower position, said piston including a tubular stem having an inner channel linking said lower chamber above said slider disc to the atmospheric air; and wherein an annular channel closed at its lower end is defined between said piston and said tubular poppet member surrounding said piston, said piston being provided at its upper end with a short sleeve fixedly attached to said piston and sealingly slidably engaging said poppet member, said poppet member annular chamber having channels therein linking same to said air reservoir, whereby compressed air is continuously present in said annular poppet member chamber for continuously biasing said piston towards said upper position by applying an upwardly oriented pressure on said sleeve member.

9. A tool as defined in claim 8, wherein said tubular piston opens into an upper chamber formed in said body and including an exhaust channel to atmospheric pressure, and said body further including a dampening chamber located above said upper chamber in which said piston moving upwardly will be decelerated before reaching its upper position.

10. A tool as defined in claim 1, further including a lateral arm secured to said body and to said handle intermediate the same, said air reservoir formed in said arm.

11. A tool as defined in claim 10, wherein said handle is generally parallel to said base and higher than said anvil.

12. A tool as defined in claim 1, wherein said trigger protrudes from said handle in said rest position of said trigger, and wherein said trigger must be squeezed against said handle to reach said operating position.

* * * * *